United States Patent [19]

Brodin

[11] 4,192,310

[45] Mar. 11, 1980

[54] DEVICE IN FLUE GAS DAMPERS

[75] Inventor: Eric Brodin, Monte Carlo, Monaco

[73] Assignee: Etablissements Unicor, Vaduz, Liechtenstein

[21] Appl. No.: 873,947

[22] Filed: Jan. 31, 1978

[30] Foreign Application Priority Data

Feb. 4, 1977 [SE] Sweden ..... 7712359

[51] Int. Cl.[2] ..... F23L 3/00

[52] U.S. Cl. ..... 126/286; 126/285 R; 137/78

[58] Field of Search ..... 137/505.47, 78, 505.46; 236/16, 92 R, 45; 431/20; 126/285 R; 110/184; 114/187

[56] References Cited

U.S. PATENT DOCUMENTS

| | | | |
|---|---|---|---|
| 1,685,205 | 9/1928 | Stein | 137/505.47 |
| 2,193,697 | 3/1940 | Roberts | 431/20 |
| 2,222,551 | 11/1940 | Ziebolz et al. | 236/92 R X |
| 2,346,559 | 4/1944 | Crew | 236/45 |
| 2,884,003 | 4/1959 | Jensen | 137/505.47 |
| 3,032,056 | 5/1962 | Riley et al. | 137/505.47 X |
| 3,388,718 | 6/1968 | Moragne | 137/494 |
| 3,587,891 | 6/1971 | Stadelman | 137/505.47 X |
| 4,076,171 | 2/1978 | Swenson | 126/285 R X |

*Primary Examiner*—William E. Wayner
*Assistant Examiner*—William E. Tapolcai, Jr.
*Attorney, Agent, or Firm*—Browdy and Neimark

[57] ABSTRACT

A device intended for flue gas passages includes a pivotable damper plate which is connected to a regulating device for automatic adjustment of the damper plate between a closed position and an open position in response to the operating condition of an installation connected to a flue gas passage. Adjustment is effected with regard to the economical operating position to prevailing outside wind conditions. An anemometric chamber with an associated diaphragm is arranged to be actuated by the gas pressure in the flue gas passage downstream of the damper plate and is connected to the damper plate in such a way that the degree of opening of the damper plate in the economical operation position is decreased for decreasing gas pressure in the flue gas passage.

10 Claims, 2 Drawing Figures

DEVICE IN FLUE GAS DAMPERS

The present invention relates to a device in flue gas dampers intended for flue gas passages, of the type comprising a pivotable damper plate which is connected to a regulating means for automatic adjustment of the damper plate between a closed position and an open economical operation position in response to the operating condition of the installation connected to the flue gas passage, for adjusting the economical operating position to prevailing outside wind conditions.

It has been previously proposed for flue gas passages, especially with oil-fired boilers, to insert in the passage a flue gas damper with automatic regulation, so that the damper is completely closed when the installation associated with the passage is not in operation, the damper being kept closed right up to the time that the installation once again begins to function, when the damper is opened to an economic operating position which can be different from the maximum opening position of the damper. An embodiment of a flue gas damper with such automatic regulation has been described in the Swedish patent application 76.10901-6.

However, it has been found that the position to which the flue gas damper is to be adjusted for attaining best possible operating economy during the functioning periods of the installation is to a very large extent dependent on the prevailing outside wind conditions. It is therefore not possible to attain maximum operating economy with a regulating device for the damper plate which does not take into account varying outside wind conditions.

The chief object of the present invention is to provide a device which enables automatic adjustment of the opening position of the damper plate to prevailing wind conditions for obtaining the best possible operating economy. This is achieved according to the invention by the apparatus being given the distinguishing features disclosed in claim 1.

An embodiment of a device according to the invention will now be described in detail below, in conjunction with the appended drawing figures.

Figure 1:
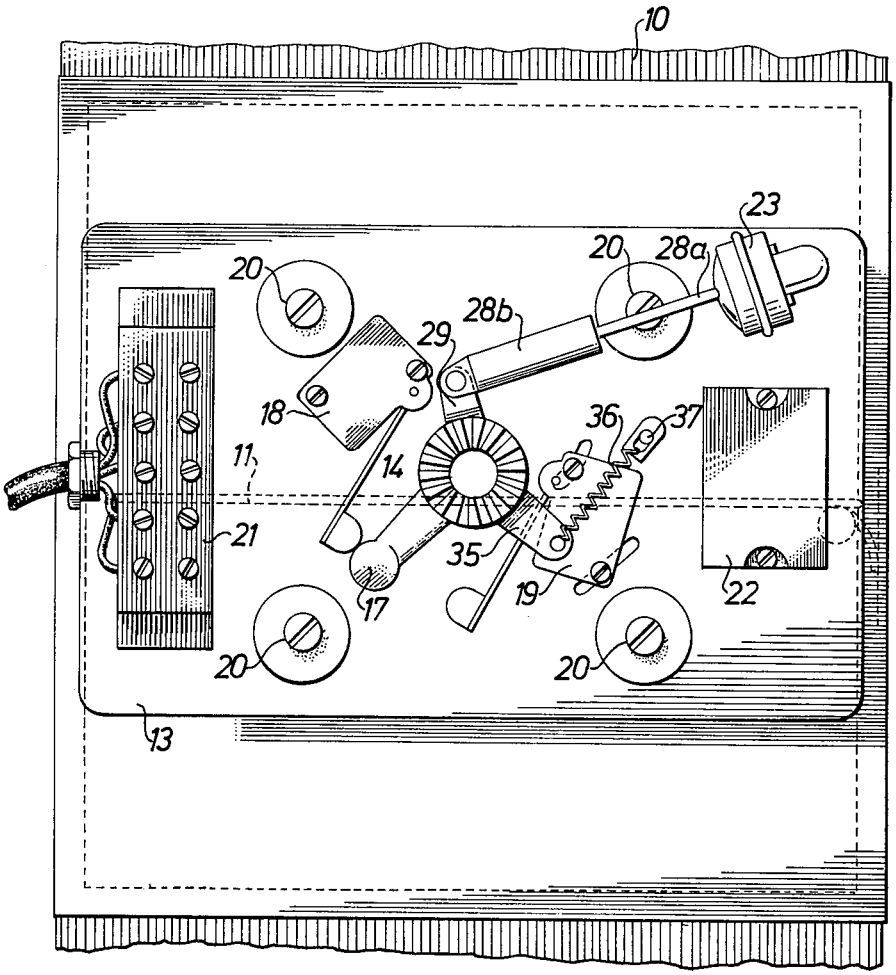
FIG. 1 shows a schematic view from above of an arrangement for automatically adjusting a flue gas damper provided with an auxiliary device according to the invention for automatically adjusting the operating economy position in relation to prevailing outside wind conditions.
Figure 2:
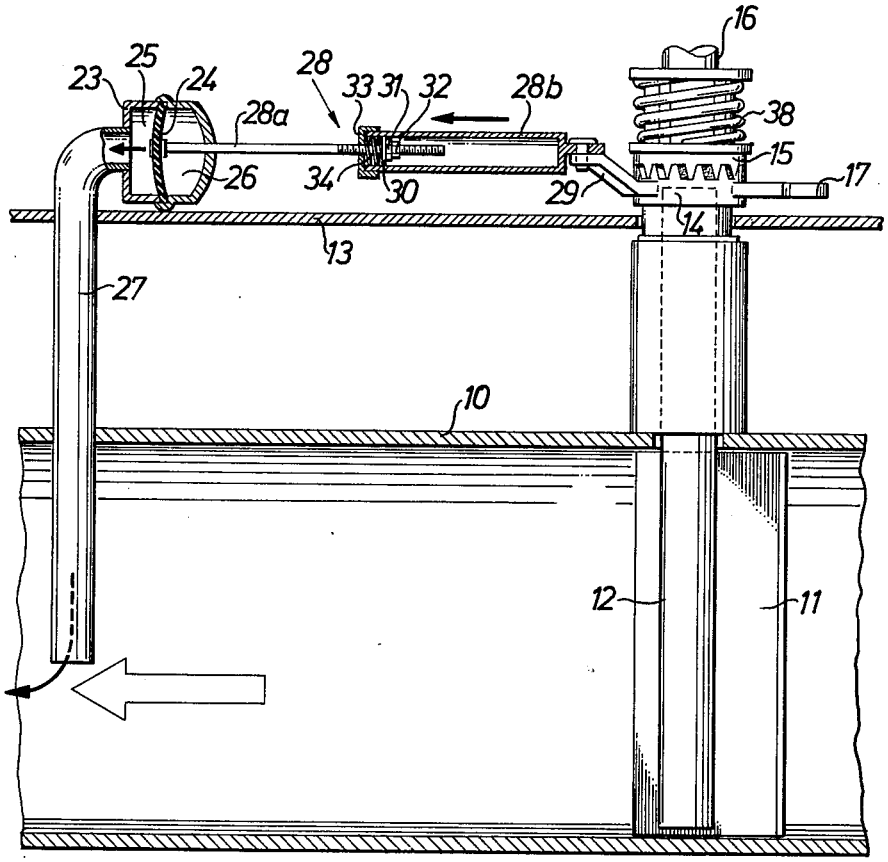
FIG. 2 shows a side view to a larger scale of the auxiliary device according to the invention.

The regulating device shown in FIGS. 1 and 2 is intended to automatically adjust a flue gas damper inserted in a flue gas passage 10 between a closed position, in which no air or gas can pass through the flue gas passage, and an open economical operating position. The flue gas damper consists of a plate 11, mounted on a shaft 12 projecting into the centre of the flue gas passage, said shaft being pivotably mounted on a mounting plate 13 attached to the outside of the flue gas passage, and carrying the parts and components incorporated in the regulating device. At its upper end the shaft 12 is provided with a toothed wheel 14, which is arranged to engage with a corresponding toothed wheel 15 attached to a driving shaft 16 connected to an unillustrated motor drive means. The damper plate shaft 12 is provided with a projecting arm 17, arranged to actuate two limit switches 18, 19 in FIG. 1, of which one 18 is arranged to stop the flue plate turning when it has arrived at the closed position, and the other 19 is displaceable to enable stopping the plate in the desired adjustable economical operation position. The carrying plate 13 is kept spaced from the wall of the flue gas passage by means of four screws 20 and corresponding unillustrated spacing tubes, and is further provided with terminal means 21 for electrical wires and with some electrical control and regulating means 22 which are not more closely described here, since they do not refer to the device now being described. The function and construction of the regulating device has been described in detail in the above mentioned Swedish patent application 76.10901-6, to which reference should be made.

An anemometric chamber 23 is arranged to provide adjustment of the economical operating position of the damper plate in correspondence with prevailing outside wind conditions, a diaphragm 24 being stretched inside the chamber and being displaceable between two end positions in response to the pressure acting on the diaphragm. The diaphragm 24 separates the chamber into two parts 25, 26, one part 25 communicating with the flue gas passage by means of a pipe 27. The pipe 27 projects into the flue gas passage on the downstream side of the damper plate 11, seen in the direction of the gases passing through the passage, and at a relatively small distance from the plate. The pressure downstream of the damper plate in the flue gas passage will thus affect the position of the diaphragm. The diaphragm is provided with an operating means 28 projecting out of the chamber, and which is pivotably connected to a second arm 29 projecting from the damper plate shaft 12. The operating means comprises two main parts, **28*a*, 28*b* of which the first part 28*a* consists of a rod and the second part 28*b* of a cylinder in which the rod can partially be inserted, so that the total length of the operating means is reduced. One end of the rod is connected to the diaphragm and the other end thereof is provided with a thread on which there is mounted a stop washer 30 and two nuts 31, 32. One end of the tube is pivotably mounted on the arm 29, and the other end is closed by means of a sleeve 33 attached to the tube, the rod passing through the sleeve 33. A compression spring 34 is arranged between the sleeve 33 on the tube and the stop washer 30 on the rod, to provide a somewhat yielding connection between these two parts of the operating means in the operating position thereof. The damper shaft 12 is provided with a third projecting arm 35, consisting of the attachment for one end of a tension spring 36, the other end of which is attached to a fixed lug 37** on the carrying plate. This spring serves to hold the operating means maximally extended, so that a diaphragm movement is always transferred via the shaft and tube to the damper plate shaft without play in the connection between the two main parts of the operating means.

So that the diaphragm in the anemometric chamber will be able to actuate the adjustment of the damper in the open position, the damper plate shaft must be able to turn to a certain extent in relation to the shaft from the driving means. This is provided by the teeth on one 14 of the toothed wheels in the connection between the damper shaft and the shaft of the driving means being substantially narrower than the space between the teeth on the other toothed wheel 15. By means of this design of the teeth in the connection there will be play or backlash, which can easily be made sufficiently large so that the required adjustment of the damper plate position can be provided by the diaphragm in the anemometric chamber. In order to utilize this backlash, however, the shaft of the drive means must be caused to turn backwards somewhat, after the damper plate has been taken to the open position, so that the teeth on the two toothed wheels in the connection can be sufficiently spaced from each other for the required rotation of the damper shaft in response to the movements of the diaphragm. This can be provided by giving a short voltage impulse to the driving means for turning its drive shaft towards damper closing, after the limit switch for the open position has stopped the driving means.

The operating means and return spring can easily be uncoupled from the arms projecting from the damper shaft, and the connection between the damper shaft and the driving means can easily be broken by displacing the toothed wheel on the driving means shaft upwards against the bias of a spring 38 so that the damper plate can easily be put into its maximally open position, e.g. for sweeping the flue gas passage.

The adjustment and function of the device described above is as follows.

The most economical setting in the open position of the damper plate is decided first for windless conditions, and the displaceable limit switch is set so that the damper plate is stopped just after this position when the damper is open. Thereafter, the operating means is attached to the arm intended for the purpose on the damper shaft, and the length of the operating means is adjusted with the aid of the stop washer and nuts on the rod 28*a*, so that the two parts of the operating means are maximally apart, when the damper plate is in the set stop position. At this setting, the diaphragm should be in the neutral position, i.e. undeflected. Since the operating means has its maximum length for this position of the diaphragm and the damper plate, every deflection of the diaphragm due to subpressure arising in the chamber part 25 will immediately result in a turning force on the damper shaft to reduce the amount of damper opening. Via the operating means the diaphragm can thus provide a turning force on the damper shaft towards damper closing for increasing subpressure, and towards damper opening for lessening subpressure in the chamber part 25. The tension spring attached to the third arm on the damper shaft provides the required force in the damper opening direction. If the stop position is correctly selected, the damper plate is turned in a closing direction towards the economy position when the installation comes into operation, due to the subpressure occurring, as will be described in detail below.

In the economy position, the flue gas damper provides an opening in the flue gas passage which is normally 15–40% of the total cross-sectional area of the passage. A usual value is 20–25%. This opening is thus provided for conditions with no wind or only a very slight wind, i.e. when the outside wind conditions do not have any effect on the anemometric chamber. When the wind increases in strength, a subpressure in the flue gas passage of the chimney is hereby developed, and this subpressure will also be noticable in the space downstream of the damper plate, where the communication pipe from the chamber opens out to the passage. A subpressure thus occurs in the part of the anemometric chamber connected to the flue gas passage, causing the diaphragm to be deflected towards the part of the chamber having the lowest pressure, as shown in FIG. 2, due to the pressure difference on either side of the diaphragm. This displacement of the diaphragm from the normal position causes a pull in the operating means so that the damper shaft is turned somewhat towards damper opening. This turning movement is possible, as mentioned above, due to the backlash in the connection between the damper shaft and the driving means shaft. The movements of the diaphragm and the damper plate play are so adjusted that a reduction of 5–10% of the total cross sectional area of the flue passage can be provided. If the economy position of the damper plate thus gives an opening in windless condition of 25% of the total flue gas passage area, and the anemometric chamber is dimensioned to provide a maximum reduction of the opening by 5% of the same area, the opening provided by the damper for heavy wind will only be 20% of the total through-flow area in the flue gas passage.

When the installation connected to the flue gas passage is started, so that flue gases flow past the damper plate and the mouth of the communication pipe to the anemometric chamber, and further through the passage, a subpressure in the chamber will be developed due to this flow of gas, independent of the outside wind conditions. This subpressure will also act on the chamber and can be utilized to compensate for the reduction in opening area which successively occurs during operation because of deposits of soot and the like being formed on the edges of the damper plate and on the passage walls adjacent to the damper plate. Since, for a newly swept flue gas passage and damper, the diaphragm is given a definite deflection towards the part of the chamber having the lower pressure, a certain increase of the damper plate opening is provided when the subpressure in the chamber, caused by the flowing flue gases, is successively reduced owing to soot deposits reducing the opening provided by the damper plate in the passage and thus reducing the gas flow. The position for good economy can thus be maintained for a longer period of time, thanks to the device according to the invention, than what would otherwise be possible.

Even if only one embodiment of the invention has been described and shown here, it is obvious that many modifications and variations are possible within the scope of the inventive concept. The operating means and anemometric chamber can for example be made in many different ways, and the return spring can similarly be arranged in another way and at other places. The communicating pipe from the chamber should open out at the place where the gas flow through the passage is heaviest, which is at the side walls of the passage in the embodiment shown. However, the communicating pipe does not need to project into the passage adjacent one of its side walls but can also be given some other location. Furthermore, amplifying or gearing apparatus can naturally be incorporated into the power transmission between the anemometric chamber and the damper plate.

What is claimed is:

1. A device in flue gas dampers intended for flue gas passages, of the type comprising a pivotable damper plate (11) which is connected to a regulating means for automatic adjustment of the damper plate betwen a closed position and an open economical operation position in response to the operating condition of an installation connected to the flue gas passage, for adjusting the economical operating position to prevailing outside wind conditions, characterized in that the regulating means comprises a means (23), sensitive to gas pressure, and arranged to be actuated by the gas pressure in the flue gas passage (10) downstream of the damper plate (11) and which is connected to the damper plate in such a way that the degree of opening of the damper plate in the economical operation position is decreased for decreasing gas pressure in the flue gas passage.

2. A device as claimed in claim 1, characterized in that the means (23) sensitive to gas pressure comprises a diaphragm (24) which is displaced in response to the gas pressure in the flue gas passage and which is provided with an operating means (28) for actuating the setting of the damper plate.

3. A device as claimed in claim 2, characterized in that the diaphragm (24) is stretched in a chamber (23) which is placed outside the flue gas passage (10) and which is in communication with the flue gas passage by means of a pipe (27) projecting into the flue gas passage adjacent the damper plate (11).

4. Apparatus as claimed in claim 3, characterized in that the connecting pipe (27) from the chamber (23) opens out into the flue gas passage adjacent a side wall in the latter.

5. A device as claimed in claim 2, characterized in that the operating means (28) is arranged to be automatically shortened during the closing movement of the damper plate (11).

6. A device as claimed in claim 5, characterized in that the operating means comprises two main parts (**28*a*, 28*b*) of which one (28*a*) is arranged so that it can be pushed into the other (28*b***).

7. A device as claimed in claim 6, characterized in that a spring (36) is arranged to turn the damper plate in a damper opening direction.

8. A device as claimed in either claim 2 or claim 3, the damper plate being mounted on a pivotable shaft (12), extending out from the flue gas passage and provided with a projecting arm (29), pivotably connected to the operating means (28), characterized in that the shaft (12) is connected to a driving means (16) for resetting the damper plate, in such a way that the damper plate is given a free play which is at least sufficiently large so that the displacement of the operating means (28) caused by the movement of the diaphragm (24) results in a corresponding rotation of the damper plate.

9. A device as claimed in claim 8, characterized in that the play in the damper plate (11) is accomplished by two toothed wheels (14, 15) in engagement with each other, of which the one (14) is arranged on the damper shaft (12) and the other (15) is arranged on the driving means shaft (16) and teeth on the two wheels being so dimensioned that the wheel fastened to the damper shaft can turn in relation to the other toothed wheel.

10. A device as claimed in any of the claims 3 or 4, characterized in that the communicating pipe (27) from the chamber (23) opens out into the flue gas passage at a place where the gas flow from the installation is heavy, so that the pressure in the chamber (23) is dependent on the speed of the gas flowing past the damper plate.

* * * * *